United States Patent [19]

Riley

[11] Patent Number: 4,683,143

[45] Date of Patent: Jul. 28, 1987

[54] METHOD AND APPARATUS FOR AUTOMATED POLYMERIC FILM COATING

[76] Inventor: John A. Riley, 905 Richmar Dr., Westlake, Ohio 44145

[21] Appl. No.: 849,473

[22] Filed: Apr. 8, 1986

[51] Int. Cl.[4] ..... B05C 15/00; B05D 5/12

[52] U.S. Cl. ..... 427/8; 118/666; 118/667; 118/690; 118/692; 427/255.6

[58] Field of Search ..... 118/666, 667, 690, 692; 427/8, 255.6

[56] References Cited

U.S. PATENT DOCUMENTS 4,495,889 1/1985 Riley ..... 118/666

4,518,623 5/1985 Riley ..... 427/255.6 X

*Primary Examiner*—Michael R. Lusignan

*Attorney, Agent, or Firm*—Watts, Hoffmann, Fisher & Heinke Co.

[57] ABSTRACT

A process and apparatus for controlled polymeric coating of a workpiece. A coating system includes a vaporizer, pyrolizer, deposition chamber, and vacuum pump. These components are depicted on a viewing screen and their status is continuously updated. The temperature, pressure, and stage of the coating process are printed on the screen as coating occurs. A permanent record of the coating process is also automatically updated as the coating process occurs.

9 Claims, 3 Drawing Figures

METHOD AND APPARATUS FOR AUTOMATED POLYMERIC FILM COATING

TECHNICAL FIELD

The present invention relates to a method and apparatus for coating film polymers onto a workpiece and more particularly to method and apparatus for monitoring and controlling such a polymer coating method.

BACKGROUND ART

The controlled coating of substrates with a film polymer by vapor deposition is disclosed in U.S. Pat. No. 4,495,889 to Riley. The process disclosed in this patent utilizes controlled vapor phase deposition of a di-p-xylylene dimer onto a substrate. The dimer is created by first vaporizing a cyclic dimer into a vapor phase and then cleaving the vapor dimer into reactive diradicals. These are conducted into a deposition chamber where a substrate or workpiece is coated. The disclosure of the '889 prior art patent is incorporated herein by reference.

The polymeric coating process of the aforementioned patent is operated in stages that can take a variable amount of time to accomplish. During a coating run, the pressure and temperature of subsystems within the coating system are monitored to achieve a coating in a minimum amount of time. Critical parameters for controlling the process have been obtained through long experience with such a system. A skilled operator familiar with the system can monitor these critical parameters and based upon his or her past experience can accurately judge when the coating process has been completed. Since a typical polymer coating process can take hours, however, it is desirable that less skilled personnel be assigned the task of monitoring these parameters without requiring the presence of one intimately familiar with the coating system.

A less experienced user cannot rely upon his or her experience in past coating runs and, must instead be given parameters indicative of the performance of the process. By monitoring these parameters, the acceptability of the coating can be determined.

The apparatus of the '889 invention includes a computer having a pressure monitor and a heater control. One task the computer of the prior art coating system performs is to monitor the monomer vapor pressure leading to the deposition chamber and control the vaporization temperature to finish a coating run in a minimal amount of time. Experience with this prior art system has indicated that while this procedure is a successful and important use of the computer a display of more information by the computer could be helpful in assessing coating operations and could be used to train and familiarize new users with the coating system.

DISCLOSURE OF THE INVENTION

The present invention automatically monitors and controls each run of a polymeric coating process. The method and apparatus of the invention periodically updates the user regarding the status of the coating process while controlling the process.

In accordance with one aspect of the invention, a vapor-phase deposition system having a vaporizer, a pyrolizer and a deposition chamber are interconnected. The pressure of these chambers is controlled by a vacuum pump. The process of the invention includes the steps of depicting the components of the system on a viewing screen to aprise a user of the interconnections and relationship between these components. This helps facilitate in training a user regarding the functioning of the system as well as facilitating the monitoring of the system operation once the training process has been completed.

The control apparatus of the invention periodically senses temperatures at locations within the system and tabulates those temperatures on the viewing screen. Preferably, this tabulation is performed while the depiction of the system is displayed. Once the user has been trained to recognize the temperatures being tabulated and coordinate those temperatures with the system components depicted on the screen, the status of the system becomes apparent.

In addition to sensing temperatures the pressures at various locations are also sensed and tabulated on the viewing screen. Since both temperature and pressure are utilized in controlling the coating process, these critical parameters allow the user to anticipate trends in the coating performance and in some circumstances eliminate the cause of a problem before the coating process is effected.

Control signals are automatically generated for closing valves and operating the vacuum pump to initiate the various stages of the coating process.

Status information in addition to the temperature and pressure of the components is also made available to the user. This information includes coating process time and an indication as to the stage of the coating process the apparatus has reached. The coating process is divided into stages or cycles and the viewing screen automatically updates this information as the process moves from one stage to the next.

An additional feature of the invention is the use of different color outputs to indicate the status of the system. Thus, when the system deviates from preset limits for various indicators, the status of these parameters changes from normal to either high or low on the viewing screen, and the color of the indication is also changed to direct attention to the change in condition.

The viewing screen is supplemented by a hard copy record of the coating process. This hard copy is generated periodically and provides a permanent record of both normal and abnormal coating operation.

It is appreciated that one object of the invention is a control method and apparatus for a coating process to enable the status of the coating process to be more accurately discerned by the user as well as automatically initiating the process through controlled outputs to valves and sensors. This and other objects, advantages and features of the invention will become better understood when a detailed description of a preferred embodiment of the invention is described in conjunction with the accompanying drawings.

BEST MODE FOR CARRYING OUT THE INVENTION

Figure 1:
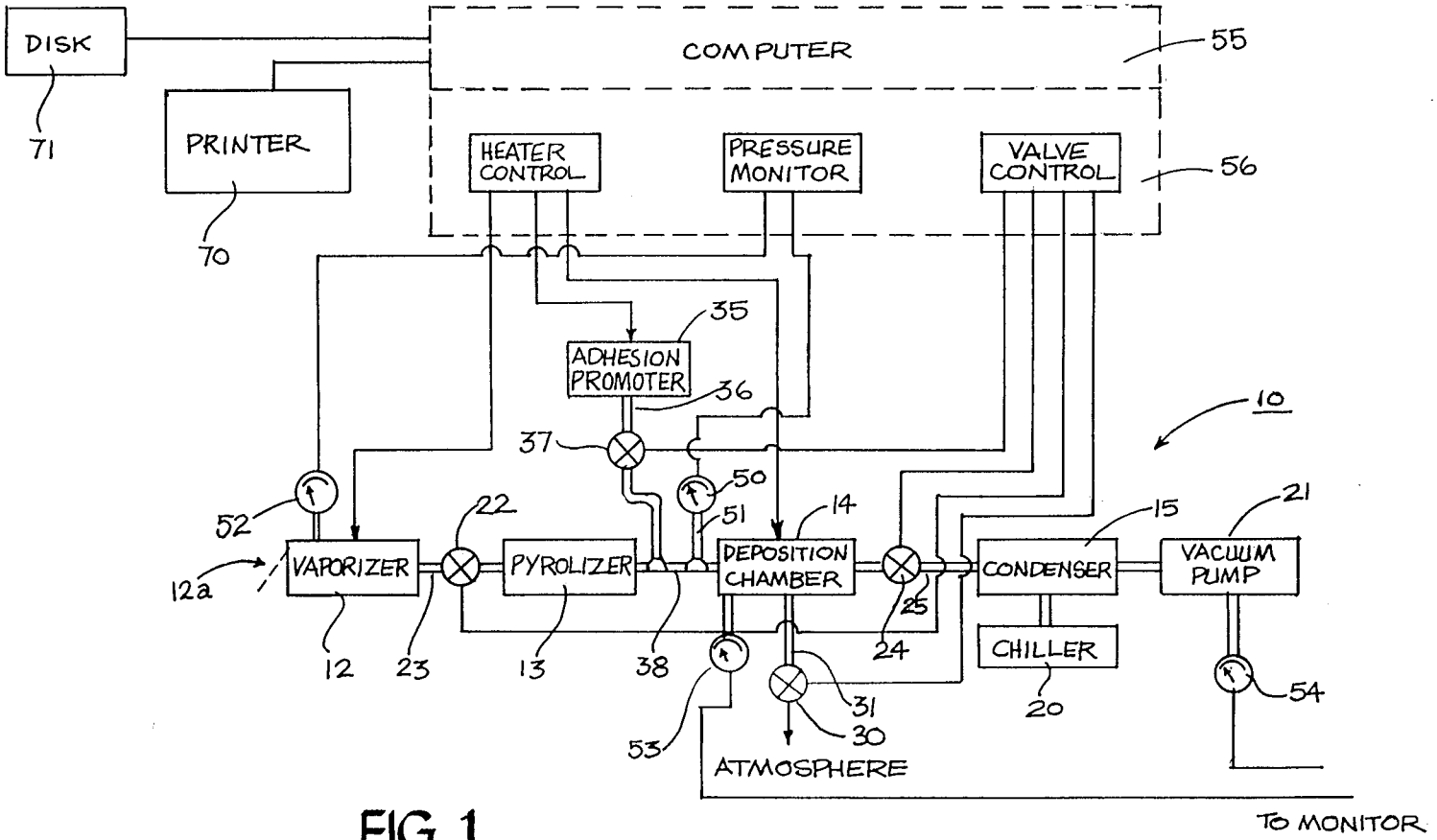
FIG. 1 is a block diagram of a polymer coating system.

Referring now to FIG. 1, coating apparatus 10 embodying the invention comprises a vaporizer 12, a pyrolizer 13, a deposition chamber 14 and a condenser 15 physically connected in series by a conduit. A chiller 20 is associated with the condenser 15 and a vacuum pump 21 is connected to the condenser in order to maintain the desired pressure conditions within the system and to draw the vapors from one chamber to the next.

As shown, a valve 22 is disposed between the vaporizer 12 and the pyrolizer 13 in a connecting conduit 23. A valve 24 is disposed between the deposition chamber 14 and the condenser 15 in a connecting conduit 25. Another valve 30 in a conduit 31 is adapted to communicate the deposition chamber 14 to the atmosphere. A source 35 of an adhesion promoter is operatively connected to the deposition chamber 14 through a conduit 36, a valve 37 in the conduit 36, and a conduit 38 which communicates the pyrolizer 13 to the deposition chamber 14. The vaporizer 12, the pyrolizer 13, the deposition chamber 14, the adhesion promoter source 35, and the valves 22, 24, 30, 37 are provided with heaters (not shown) for controlling the temperature of fluid flowing through the chambers.

Cyclic di-p-xylylene in powder form is introduced into the cold vaporizer 12 through a door 12*a*. Vaporized dimer passes through the conduit 23 and the valve 22 into the pyrolizer 13 where the vapor is pyrolized to monomeric diradicals. The p-xylylene diradical or monomer vapors are then passed into the deposition chamber 14 where they are deposited onto workpiece surfaces located in the chamber. Unreacted dimer vapor is drawn out of the deposition chamber 14 through the valve 24 and conduit 25 into the condenser 15.

The polymerization rate in the chamber 14 is measured by a pressure sensor 50. The sensor 50 is connected by a conduit 51 to the conduit 38 leading from the pyrolizer 13 into the deposition chamber 14. Thus connected, the sensor 50 senses the pressure of the monomer vapor which is an effective way of determining the arrival rate of monomer molecules in the deposition chamber 14. Three additional pressure sensors 52–54 monitor the pressure within the vaporizer 12, deposition chamber 14 and the vacuum pump 21.

The apparatus 10 includes a computer 55 which includes an interface 56 having circuitry to monitor pressure sensed by the sensors 50, 52, 53, 54, a heater control, and a valve control. The heater control is connected to the internal heaters (not shown) of the vaporizer 12, the deposition chamber 14, the adhesion promoter source 35 as well as a number of other heaters used to regulate the temperature of the apparatus 10. The valve control is operatively connected to the valves 22, 24, 30, 37.

A preferred computer 55 comprises an IBM personal computer equipped with a color graphics adapter board, color monitor, and an interface card 56 for monitoring pressures and temperatures and controlling the status of solenoid actuated control valves 22, 24, 30, 37.

Figure 2:
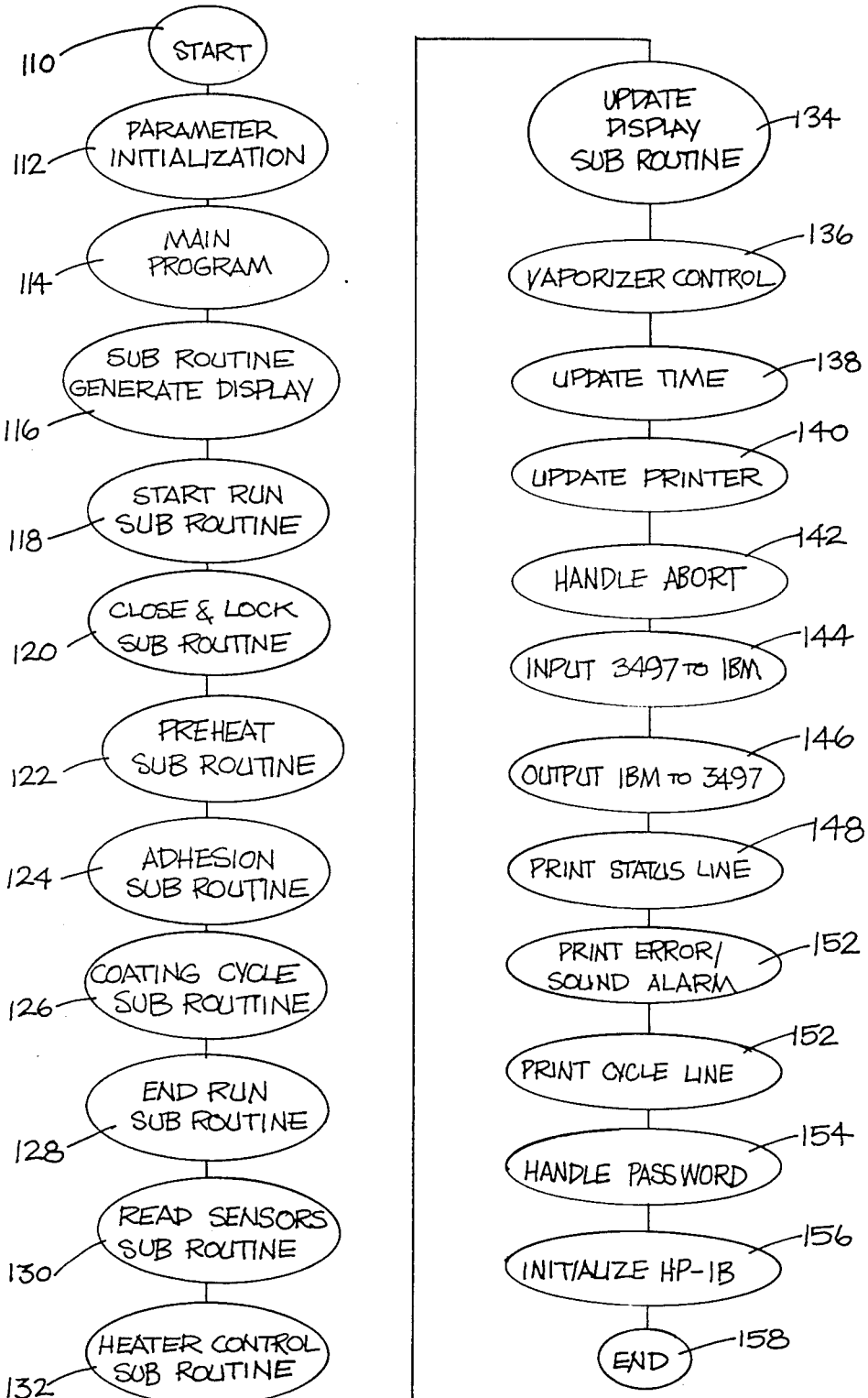
FIG. 2 is a flowchart of a control algorithm for practicing the coating control process of the invention.
Figure 3:
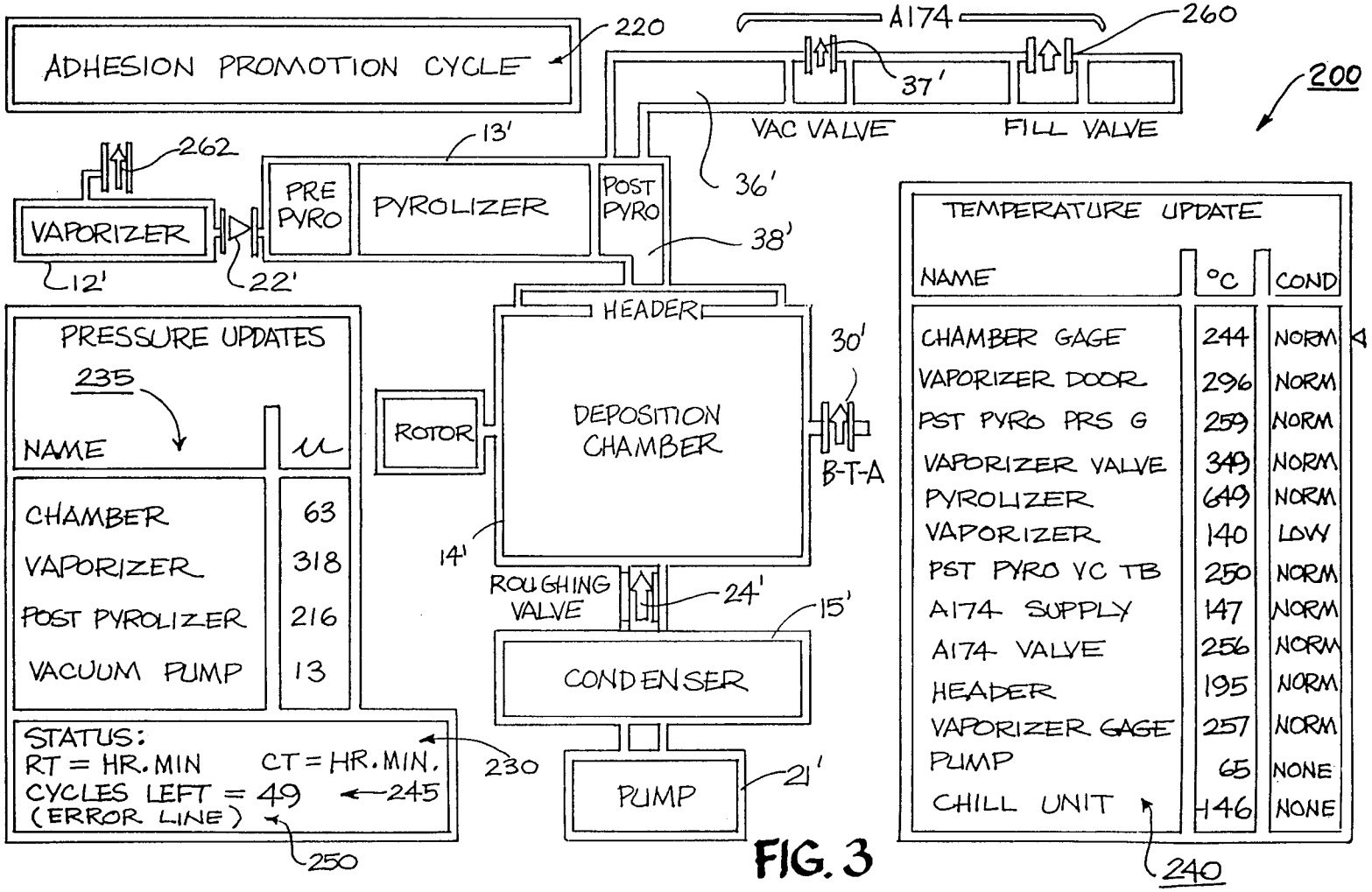
FIG. 3 is an elevation view of a viewing screen or monitor for updating a user regarding the status of the FIG. 1 coating system.

Turning now to FIGS. 2 and 3, a control program summarized in the flow diagram of FIG. 2 is executed by the computer 55 and controls the coating process as well as updating a user regarding status of that coating process. At a first step 110, the user turns on the computer and the user is prompted to enter a password. In monitoring and controlling the coating process, the computer 55 executes a program that accesses a number of subroutines. The first such subroutine 154 handles the inputting of the password. If the password is properly entered, the computer 55 initializes 112 certain parameters used in a control run of the coating process. The parameters are read from a disk storage into the main memory of the computer. The control parameters can be set by the user by executing a parameter initialization program separate from the coating control program of FIG. 2. The parameter initialization routine allows the user to set control parameters such as critical times, temperatures, and pressures used by the computer 55 in assessing the status of the coating run and controlling that run.

At this stage certain specialized subroutines are also initialized 156 by loading the subroutines from disk to enable the computer to access data from the interface 56 that sends and receives inputs to and from the coating apparatus 10. Subsequent to the parameter initialization 112, the program begins 114 by generating 116 a display on a viewing screen or monitor 200 (FIG. 3). In generating the display depicted on the viewing screen 200, the computer 55 accesses display data stored on disk.

At a start subroutine 118, the computer 55 checks the status of the valves 22, 24, 30, 37, to determine whether the status of these valves is appropriate (open or closed). Turning to FIG. 3, the computer 55 automatically provides a visual indication of the status of the valves 22, 24, 30, 37. If a valve is open, an arrow (22' for example) indicates the passage of fluid through the valve. If the valve is closed, the arrow is turned to indicate the fact that no fluid can pass a particular valve. If an error is sensed at this stage of the operation, an error signal is generated on the screen by an error message routine 150 to apprise the user that the status of the system valves is not appropriate for the coating run to begin.

Many elements diagrammatically depicted by the computer 55 on the screen 200 correspond to physical elements of the apparatus 10. A prime notation (') is used to designate these elements on the screen.

To gain access to the sensor data a "read sensors" subroutine 130 is accessed by the start subroutine 118. The "read sensors" subroutine 130 in turn accesses an even more specialized subroutine 144 that reads data from the 16 bit input/output interface card which preferably is a commercially available Hewlett-Packard no. 3497 interface card.

If the valve settings are correct, the computer 55 enters a close and lock routine 120. As the computer enters this routine, a message is generated on a cycle line 220 (FIG. 3) by a cycle line print subroutine 152 instructing the user to close and lock the deposition chamber door through which workpieces to be coated were inserted into the deposition chamber. The close and lock routine 120 checks the door by instructing the interface card 56 to latch data indicative of the status of a microswitch that senses when the door is closed.

The close and lock routine 120 checks the speed of rotation of a motor driven rotor within the chamber 14 that rotates workpieces supported inside the chamber. The routine 120 also closes the valve 30 (and changes the orientation of the arrow 30') and activates the pump 21 to lower the pressure within the deposition chamber 14. A vaporizer valve 262 (FIG. 3) connects the vaporizer 12 to the pump 21 so that the pressure in the vaporizer is also lowered.

A status message is generated on a status line 230 (FIG. 3) by a status message subroutine 148 telling the user that the pump is lowering the pressure within the chambers 12, 14. Also, the sensor reading routine 130 and a display update routine 134 are accessed to acquire and update pressure values indicated in a pressure update portion 235 of the screen 200. The computer 55 continually monitors the chamber pressures (and displays these pressures on the screen) until the pump 21 has reduced the pressures to acceptable levels.

The computer 55 makes decisions based upon voltages input through the interface 56. In order to display the pressures and temperatures in units the user can comprehend, the computer 55 converts these voltages to microinches of mercury (pressure) and degrees celsius (temperature).

A preheat routine 122 is entered by the computer 55 once the chamber pressure is low enough. The cycle line 220 is updated with a message "PREHEAT CYCLE." This message is also sent to a hard copy printer 70. From this point on in the coating process, this printer 70 prints out sensed temperature, pressures, and cycle times under control of a printer update routine 140. At the same time a printer output is generated, a disk file stored on a disk storage device 71 is updated so that two permanent records of the run are created. In conjunction with this process a timer update routine 138 continually times the passage of time from the beginning 118 of the program.

The preheat subroutine 122 generates outputs to heaters and monitors the performance of those heaters via the interface card 50. To monitor performance of the abovementioned heaters, the apparatus 10 comprises a plurality of thermocouple temperature sensors that sense the temperature of components (the deposition chamber, for example) and transmit this information to the computer 55. To accomplish this function the sensor input routine 130 and a heater control output routine 132 are continually accessed until the sensed temperatures fall within a predetermined range. The heater control and valve control operations both access a special interface output routine 146 to transmit control signals from the computer to the apparatus. Table I below indicates control values for these temperatures in degrees Celsius.

TABLE I

| NAME | LOW | HIGH | CONTROL |
|---|---|---|---|
| Chamber Gage (30) | 200 | 300 | 250 |
| Vaporizer Door | 275 | 325 | 300 |
| Pst Pyro Prs G (50) | 200 | 300 | 250 |
| Vaporizer Valve (22) | 325 | 375 | 350 |
| Pyrolizer (13) | 600 | 700 | 650 |
| Vaporizer (12) | 150 | 305 | 225 |
| Pst Pyro Vc Tb (38) | 230 | 275 | 250 |
| Adhesion Spp. (35) | 200 | 295 | 225 |
| Adhesion Valve (37) | 225 | 275 | 250 |
| Header (38) | 180 | 210 | 195 |
| Vaporizer Gage (52) | 325 | 375 | 350 |

As the pre-heat subroutine progresses, a temperature update portion 240 of the screen 200 is updated by the display update routine 134. When all temperatures have reached a control range between the "high" and "low" values of Table I, the computer progresses to an adhesion promoting routine 124. The screen cycle line 220 and printer are updated to indicate a new cycle has been entered.

The computer 55 sequentially checks the pump pressure, closes the valve 24 between the pump 21 and chamber 14 and opens the adhesion valve 37 causing the workpieces inside the chamber to be coated with an adhesion promotor. The FIG. 3 depiction of the viewing screen is representative of data presented to the user during the adhesion promotion cycle. The adhesion promotor is an organo functional sylane commercially available under the designation A174. During this cycle an adhesion promoting heater is turned on to promote adhesion flow to the chamber 14. Before the valve 37 is closed (to end flow of the adhesion promotor) a vaporizer heater is turned on and the vaporizer valve 22 is opened. The timing of these steps is controlled by the computer 55 and is displayed on a cycle line 245 (FIG. 3) that is updated on the screen 200. The valve 37 is closed and the vaporizer is brought up to temperature during a timed vaporizor heating cycle.

A final subroutine in the coating process is a coating cycle routine 126. During this routine the computer 55 continuously senses data, accesses the heater control routine 132, updates the display temperatures and pressures 134 and executes a vaporizer control routine 136. The vaporizer control routine is a specialized routine that controls vaporizer temperatures and therefore pressure in accordance with the disclosure of the '889 prior art patent to Riley.

An end in the coating cycle is indicated by a rather precipitous drop in post-pyrolizer pressure measured by the sensor 50. When this pressure drops below a control threshold (entered via the parameter initialization program), coating is complete and the computer enters an end run subroutine 128. In the end run routine 128 the cycle line 220 is updated to indicate an "END OF PROCESS" has been reached. The printer 70 also gives this indication and all valves and heaters are closed and turned off. The status line is updated to indicate the coating run has been completed and the user is prompted to "press any key to start another run" by a prompt on an error line 250. This is generated by an error/sound alarm routine 150 that in addition to printing on the error line 250, generates an audible alarm via a computer speaker. The available alarm routine 150 controls the duration, pitch, and intensity of each warning so that the type of problem can be discerned and, if needed, appropriate action taken.

The error line 250 is printed to whenever an error is detected. As an example, during the close and lock routine 120, if the rotor speed sensor input indicates a problem with the rotor motor, a message is displayed telling the user to check the rotor.

One last routine 142 can be accessed at any time by the user if he or she wishes to abort a coating run. By pressing a special function key on the computer keyboard the coating run is aborted. A message is displayed that the user aborted the run and the computer branches to the end run subroutine 128.

Once the end run routine 128 is completed the user can initiate another coating run or can end 158 the operation by turning off the computer 55. If the user starts another coating run, the preheat routine where the apparatus heaters are energized will take less time and subsequent run times (RT) will be shorter.

At the end of each run the user has a hard copy printout of the periodically sensed pressures and temperatures for the coating run as well as a running indication of elapsed time since the beginning of the main program, run time (RT), and the time for the coating cycle (CT). The temperatures are recorded in degrees Celsius, the pressures in microns of mercury and the elapsed time in hours and minutes.

A preferred screen 200 comprises a color monitor. The apparatus components are outlined in a color different from a border color for the tables of temperature and pressure and the message areas. The color of the temperature condition column changes if the sensed temperatures deviate above or below the Table I ranges. This color control in combination with audible warnings through the computer speaker inform the user when the system deviates from normal operation.

Two valves 260, 262 depicted on the screen 200 correspond to valves for adding adhesion promotor to the adhesion source 35 and for connecting the vaporizer 12 to the pump 21. These valves are presently manually opened and closed. Their status, however, is automatically sensed and it is within the scope of the invention to automatically control their status via the computer 55.

Although the present invention has been described with a degree of particularlity, it is the intent that the invention include all modifications and alterations from the disclosed embodiment falling within the spirit or scope of the appended claims.

I claim:

1. A method for conducting a vapor phase deposition process comprising the steps of:

(a) placing a workpiece within a deposition chamber and evacuating the deposition chamber;

(b) vaporizing a dimer in a vaporizer chamber;

(c) cleaving the dimer in a pyrolizer chamber to produce a reactive vapor;

(d) condensing the reactive vapor onto a workpiece in the evacuated deposition chamber;

(e) generating control signals for routing said vapor from the vaporizer chamber to the pyrolizer chamber and then to the deposition chamber;

(f) controlling vapor pressures as vapor is routed from the pyrolizer chamber to the deposition chamber by controlling vapor temperature; and (g) monitoring progress of the deposition process to apprise an operator of the status of the process; said monitoring step comprising the substeps of:

(i) depicting the vaporizing chamber, pyrolizer chamber and deposition chamber and conduits connecting said chambers on a viewing screen;

(ii) periodically sensing temperatures of at least some of said chambers and conduits, tabulating said temperatures on the viewing screen, comparing said temperatures with predetermined upper and lower limits, and indicating whether the temperatures fall within the limits;

(iii) periodically sensing pressures within one or more of said chambers and conduits and tabulating said pressures on the viewing screen; and (iv) presenting one or more indicators on the viewing screen co-ordinated with the generation of the control signals to indicate a progression of the vapor phase deposition process through a number of stages.

2. The process of claim 1 where the monitoring step includes the substep of presenting an indication of an elapsed time of stages of said vapor phase deposition process.

3. The process of claim 1 where the step of generating at least one of said control signals is initiated by comparing predetermined pressures with pressures sensed within the system.

4. The process of claim 1 additionally comprising the step of periodically generating a hard copy indication of the status of the system.

5. The process of claim 1 where the step of generating control signals comprises the steps of storing control parameters and comparing the control parameters with sensed information to determine if a next coating cycle of said coating process should be performed.

6. The process of claim 5 including a step of generating both visual and audible error messages when the sensed parameters deviate from the control parameters.

7. In a vapor phase deposition system including a vaporizer for vaporizing a dimer, a pyrolizer for cleaving the dimer to produce a reactive vapor, a deposition chamber where the vapor is condensed onto a workpiece, and a pump for controlling pressure within said vaporizer, pyrolizer and chamber, apparatus for monitoring said system comprising:

viewing means for depicting components of the deposition system on a viewing screen to show interconnections between a number of components of said system;

temperature sensing means for periodically sensing temperatures at locations within the system and tabulating said temperatures on the viewing screen;

pressure sensing means for periodically sensing pressures at locations within the system and tabulating said pressures on the viewing screen;

output means for generating control signals to automatically conduct the vapor deposition process; and processor means for updating the status of said process on said viewing screen to enable a user to monitor said process.

8. The apparatus of claim 7 where the processor means comprises memory means for storing control parameters relating to process times, process temperatures, and process pressures to control said apparatus from one processing stage to a next subsequent processing stage and for updating said viewing means as said process progresses through said stages.

9. The apparatus of claim 7 additionally comprising means coupled to the processor means for generating a hard copy indication of the status of the deposition system at regular time intervals under control of the processor means.

* * * * *